United States Patent [19]

Garcia

[11] 4,041,885

[45] Aug. 16, 1977

[54] APPARATUS FOR AND METHOD OF STABILIZING A MARINE VESSEL IN PITCH

[76] Inventor: Emilio C. Garcia, 441 Gravier St., New Orleans, La. 70130

[21] Appl. No.: 645,746

[22] Filed: Dec. 31, 1975

[51] Int. Cl.[2] ..... B63B 39/06

[52] U.S. Cl. ..... 114/126; 114/282

[58] Field of Search ..... 114/126, 66.5 H, 274–282, 114/284

[56] References Cited

U.S. PATENT DOCUMENTS

| | | | |
|---|---|---|---|
| 2,858,788 | 11/1958 | Lyman | 114/126 |
| 3,176,644 | 4/1965 | Thomas et al. | 114/126 |
| 3,745,959 | 7/1973 | Coffey et al. | 114/66.5 H |

*Primary Examiner*—Stephen G. Kunin
*Assistant Examiner*—Sherman D. Basinger
*Attorney, Agent, or Firm*—James B. Lake, Jr.

[57] ABSTRACT

A non-lift or zero average lift bow foil, having similar wing-shaped members defining an angular intersection therebetween with similar dihedral angles, is mounted on a vessel's bow centerline, with the angular intersection approximately parallel to the vessel's keel, and is adjustable vertically for submersion to approximately keel level from above the waterline of the vessel.

1 Claim, 4 Drawing Figures

APPARATUS FOR AND METHOD OF STABILIZING A MARINE VESSEL IN PITCH

BACKGROUND OF THE INVENTION

1. Field of the Invention

The invention relates generally to hydro-foils, and more particularly to a non-lift or zero average lift bow foil that is adjustable vertically.

2. Description of the Prior Art

It is old in the art to employ stationary lift foils mounted below a vessel's waterline for lifting the vessel when underway paartially or entirely out of the water for planing thereover.

SUMMARY OF THE INVENTION

It is an object of the invention to provide a non-lift stabilizing foil in the bow of a marine vessel for reducing the pitch and thus a change of draft at the ends thereof in rough seas at high speeds, and thereby limiting taking water over the bow at one end and exposing the propeller at the other and the pounding or slamming of the hull.

Another object of the invention is to provide a method of improving the seakeeping ability of a vessel in rough weather.

DESCRIPTION OF THE INVENTION

The invention is best suited to the older type of fast vessels, that is the relatively longer and narrower ones having a ratio of dimensions similar to a vessel of overall length of 149 feet 6 inches, beam of 21 feet, and depth of 11 feet 6 inches.

Figure 1:
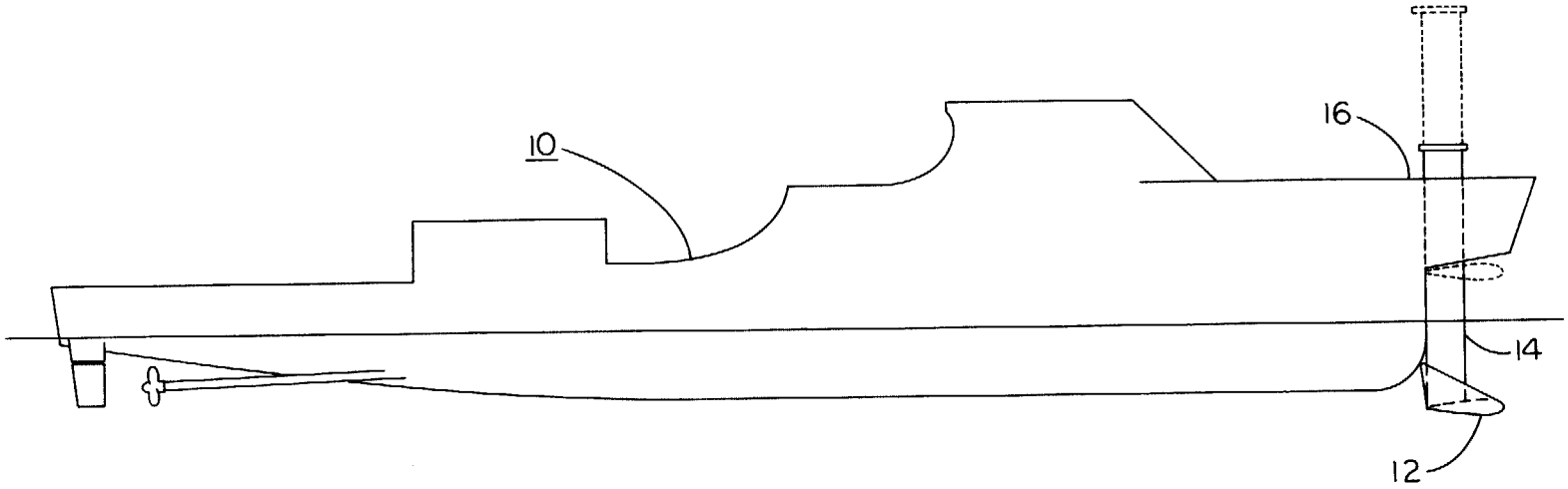
FIG. 1 is a side view of a marine vessel with the invention mounted in the bow in its submerged position and with a raised position indicated in dotted lines.
Figure 2:
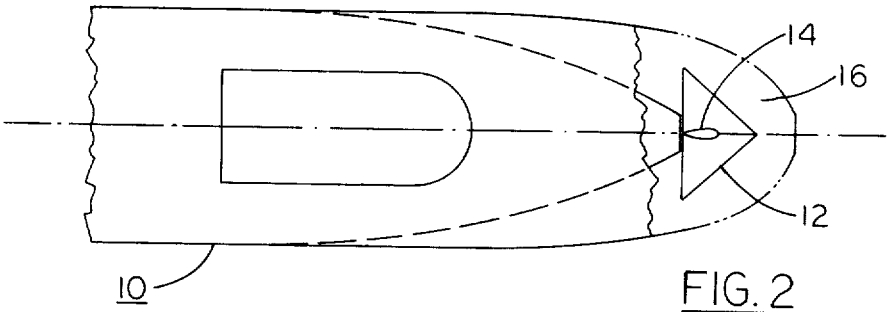
FIG. 2 is a partial plan view of FIG. 1 showing the bow cutaway.
Figure 3:
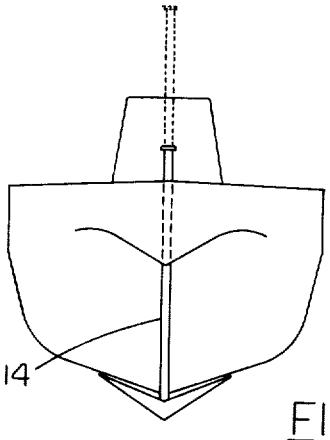
FIG. 3 is a front end view of FIG. 1.

Referring to FIGS. 1–3, the invention comprises a marine vessel 10 on which a non-lift or zero average lift foil 12 is fixed to a lower end of a vertical member 14 which is mounted for vertical adjustment in the bow 16 of said vessel, such that it is in alignment with and forward of the keel of the vessel.

Figure 4:
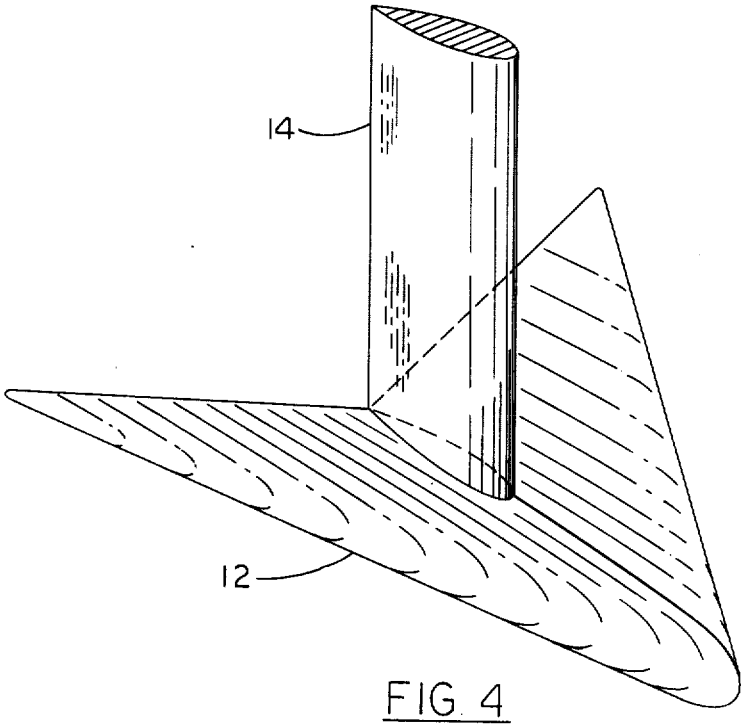
FIG. 4 is three dimentional view of the invention with a shortened vertical member.

Referring to FIG. 4, the non-lift foil has the following physical characteristics:

| | |
|---|---|
| aspect ratio | 2.000 |
| chord/thickness | 0.1500 |
| dihedral angle | 36.87 degrees |
| foil span | 12' (feet) |
| max. width wing | 6' (feet) |

Vertical member is faired as shown in cross-section in FIGS. 2 and 4. For raising and lowering the vertical member 14 together with the non-lift or zero average lift foil 12 any convenient device (not shown) can be used, such as rack and pinion, and falls with a winch.

In use the vertical member and non-lift or zero average lift foil 12 are lowered from a normally raised position as shown in dotted lines in FIG. 1 to an operational positional in rising seas as shown in solid lines in FIGS. 1–3. In the operational position non-lift foil 12 acts as a stabilizer of the vessel in rising seas that reduces pitch and variations in draft at the bow and the stern.

A summary of tests and results carried out in a test basin are as follows:

| tests | without foil | | with foil | |
|---|---|---|---|---|
| wave height | 15' | | 15' | |
| heave | 16.3' | | 13.8' | |
| pitch (degrees) | 12.68 | | 6.86 | |
| added power (hp) av. | 841 | | 610 | |
| pounds or slams/hr/ | 341 | | 88 | |
| deck subm/hr. | 121 | | 6 | |
| prop.racing/hr. | 0.02 | | 0.04 | |
| acceleration (ft/sec²) | | | | |
| 25% fwrd. that is one quarter length from bow of vessel | | | | |
| RMS (root means square, a statistical term for averaging positive and negative values) | 12.75 ft./sec² | (.39g) | 6.2 ft./sec² | (.19g) |
| significant or average of the highest third of recorded values | 52.00 | (1.58g) | 24.9 | (.77g) |
| Avg. highest 1/10 of recorded values | 65.00 | (2.02g) | 31.7 | (.96g) |
| 25% aft that is one quarter length from stern of vessel | | | | |
| RMS (root means square, a statistical term for averaging positive and negative values) | 8.94 ft./sec² | (.28g) | 7.55 ft./sec² | (.23g) |
| significant or average of the highest third of recorded values | 35.90 | (1.11g) | 29.9 | (.94g) |
| Avg. highest 1/10 of recorded values | 46.00 | (1.42g) | 38.6 | (1.20g) |

In addition certain probabilities were worked out from the statistics and are as follows:

of shipping water without foil - 7.8%; with foil - 0.14%, of bow emergence without foil - 30%; with foil - 7%, of slamming or pounding without foil - 24%; with foil - 4%.

The non-lift or zero average lift foil is an isosceles triangle having the two equal sides forming a leading angle of 90°, the equal sides respectively forming 45° angles with the third side which is transverse the longitudinal centerline of the vessel. The foil is divided into two similar triangular wings by bending along a line bisecting the third side and the 90° angle, the wings defining dihedral angles of 36.87° and an intersection angle of 106.26° along the bisecting line.

What is claimed is:

1. A pitch stabilizing device for a relatively narrow and fast marine vessel, having a bow, waterline and keel, and moving rapidly in high seas, comprising in combination:

a. vertical member means, having oppositely disposed upper and lower ends, vertically mounted in said bow and in alignment with and forward of said keel, said vertical member means for raising above said waterline and lowering said lower end to approximately keel level and forwardly thereof, and faired for its length to reduce resistance as it is moved rapidly through said high seas; and b. triangular shaped foil means, having zero lift characteristics and equal sides defining a leading angle, mounted on said lower end of said vertical member means and defining a dihedral angle therewith, said foil means extending forwardly and transverse said vertical member means and in alignment with said keel, whereby said foil means with zero lift characteristics when lowered to keel level at the bow of said rapidly moving narrow vessel engages said high seas to stabilize said vessel in pitch.

* * * * *